US006622592B2

(12) United States Patent
Lee

(10) Patent No.: US 6,622,592 B2
(45) Date of Patent: Sep. 23, 2003

(54) ATTACHABLE PEDAL COVER FOR AUTOMOBILE PEDALS

(76) Inventor: Song Geol Lee, 1115-24 Yeonsan 4 Dong, Yeonje Gu, Busan (KR)

( * ) Notice: Subject to any disclaimer, the term of this patent is extended or adjusted under 35 U.S.C. 154(b) by 0 days.

(21) Appl. No.: 10/077,961

(22) Filed: Feb. 20, 2002

(65) Prior Publication Data

US 2003/0154818 A1 Aug. 21, 2003

(51) Int. Cl.[7] ..... G05G 1/16
(52) U.S. Cl. ..... 74/563; 74/560; 74/561
(58) Field of Search ..... 74/560, 567, 561, 74/512–514, 562, 563, 562.5

(56) References Cited

U.S. PATENT DOCUMENTS

| | | | | | |
|---|---|---|---|---|---|
| 5,609,069 | A | * | 3/1997 | Swenson | 74/563 |
| 5,673,597 | A | * | 10/1997 | Lin | 74/563 |
| 5,884,534 | A | * | 3/1999 | Knoll et al. | 74/562 |
| 5,913,948 | A | * | 6/1999 | Lien | 74/563 |

FOREIGN PATENT DOCUMENTS

| | | | | | |
|---|---|---|---|---|---|
| DE | 19824755 | A1 | * | 12/1999 | 74/563 |
| DE | 10032574 | A1 | * | 1/2002 | 74/563 |
| GB | 2064732 | A | * | 6/1981 | 74/563 |
| JP | 6-51854 | | * | 2/1994 | 74/563 |
| JP | 2000-24254 | | * | 9/2000 | 74/563 |
| JP | 2000-242355 | | * | 9/2000 | 74/563 |
| JP | 2001-84048 | | * | 3/2001 | 74/563 |

* cited by examiner

*Primary Examiner*—Vinh T. Luong
(74) *Attorney, Agent, or Firm*—GWiPS

(57) ABSTRACT

An attachable pedal cover is designed to mount over an automobile pedal, such as an accelerator pedal, brake pedal or clutch pedal for preventing an operator's foot from slipping during operation of pedals. The attachable pedal cover is comprised of a rubber pad with anti-slip protrusions for preventing slipping of the operator's foot and a holding cap being made of a stainless or colored aluminum for snapping in the pedal cover over automobile pedals. The holding cap also serves a decorative function for improving the appearance of pedals.

7 Claims, 7 Drawing Sheets

ATTACHABLE PEDAL COVER FOR AUTOMOBILE PEDALS

BACKGROUND OF THE INVENTION

1. Field of the Invention

The present invention relates to a pedal cover attachable to automobile pedals, such as an accelerator pedal, brake pedal and clutch pedal for preventing an operator's foot from slipping during pedal operation. More particularly, the attachable pedal cover is comprised of a rubber pad with anti-slip means and a holding cap made of a stainless or colored aluminum for snapping in the anti-slip means on conventional automobile pedals. The holding cap has not only a mounting means, but also has a decorative feature.

2. Background of the Related Art

As shown in FIG. 1, a brake system serving as a means of decelerating or stopping an automobile includes a master cylinder 11, a foot lever 12 with hinge 13 and a cylinder rod 14. The cylinder rod 14 is connected to the master cylinder 11 and foot lever 12 for mechanically generating hydraulic pressure. by depressing the brake pedal. The operational interval of the cylinder rod 14 is adjustable depending on the stroke of the rod movement. The foot lever 12 is integrally formed with a flat pedal 200 so that the operator can easily depress the brake pedal. When the operator depresses the brake pedal, the foot lever 12 pushes the cylinder rod 14 forward to actuate the master cylinder 11. Then, the master cylinder 11 generates the proper hydraulic pressure to activate the brake system to decelerate or stop the car.

Generally, the flat pedal coming into contact with the operator's foot is covered with a rubber pad having a plurality of grooves vertically or horizontally arranged at predetermined intervals to prevent the operator's foot from slipping from the pedal during operation. The flat pedal could be the accelerator pedal, clutch pedal or the brake pedal.

As shown in FIG. 5, a conventional rubber pedal cover has a L-shaped edge integrally formed with the flat pedal by peripherally wrapping the back edge of the flat pedal. When the rubber pedal cover is installed on the flat pedal, the L-shape portion of rubber pedal cover is forcibly widened to set on the flat pedal. This conventional method of installation is often causes the rubber pedal cover to tear off, resulting in undesirable costs to the operator. There are other problems that occur when installing the rubber pedal cover within a relatively narrow place. Also, it requires a relatively longer time to mount the conventional rubber pedal cover on the flat pedal. Specifically, once the rubber pedal cover is molded to form a predetermined shape, it should forcibly widen the edges of the L-shape portion to set on or remove from the flat pedal.

In addition, most rubber pedal covers are black in color and are of poor quality, which degrades the appearance of the car's interior as a whole. This is not a desired feature for car owners who want to gracefully decorate the interior of their car.

SUMMARY OF THE INVENTION

Accordingly, the present invention is concerned with an attachable pedal cover that substantially obviates the above-mentioned conventional problems.

An objective of the present invention is to provide an attachable pedal cover comprised of a rubber pad with an anti-slip means for preventing slipping of the operator's foot during pedal operation and a holding cap made of a stainless or colored aluminum for snapping in the pedal cover on the flat pedal.

Another objective of the present invention is to provide an attachable pedal cover that easily snaps in and out of place without specific tools. The present invention allows for easy installation and removal of the attachable pedal within a relatively narrow place.

Additional advantages, objects, and features of the present invention will be set forth in part in the description which follows and will become apparent to those having ordinary skill in the art upon examination of the following or may be learned from practice of the present invention.

The objectives and other advantages of the present invention may be realized and attained by the structure particularly pointed out in the description and claims hereof, as well as the appended drawings.

To achieve the objectives and other advantages in accordance with the purpose of the present invention, as embodied and broadly described herein, an attachable pedal cover is provided. The attachable pedal cover includes a rubber pad with a plurality of anti-slip protrusions on its surface that has the same shape and curved surface as a pedal and a holding cap with a plurality of slot-holes for inserting the plurality of anti-slip protrusions. A coupling clip is attached to the cap's top edge and a locking projection is attached to its bottom edge, forming a latching system to latch the pedal.

DETAILED DESCRIPTION OF THE PREFERRED EMBODIMENT

An attachable pedal cover of the present invention is disclosed in detail accompanying the drawings.

Figure 1:
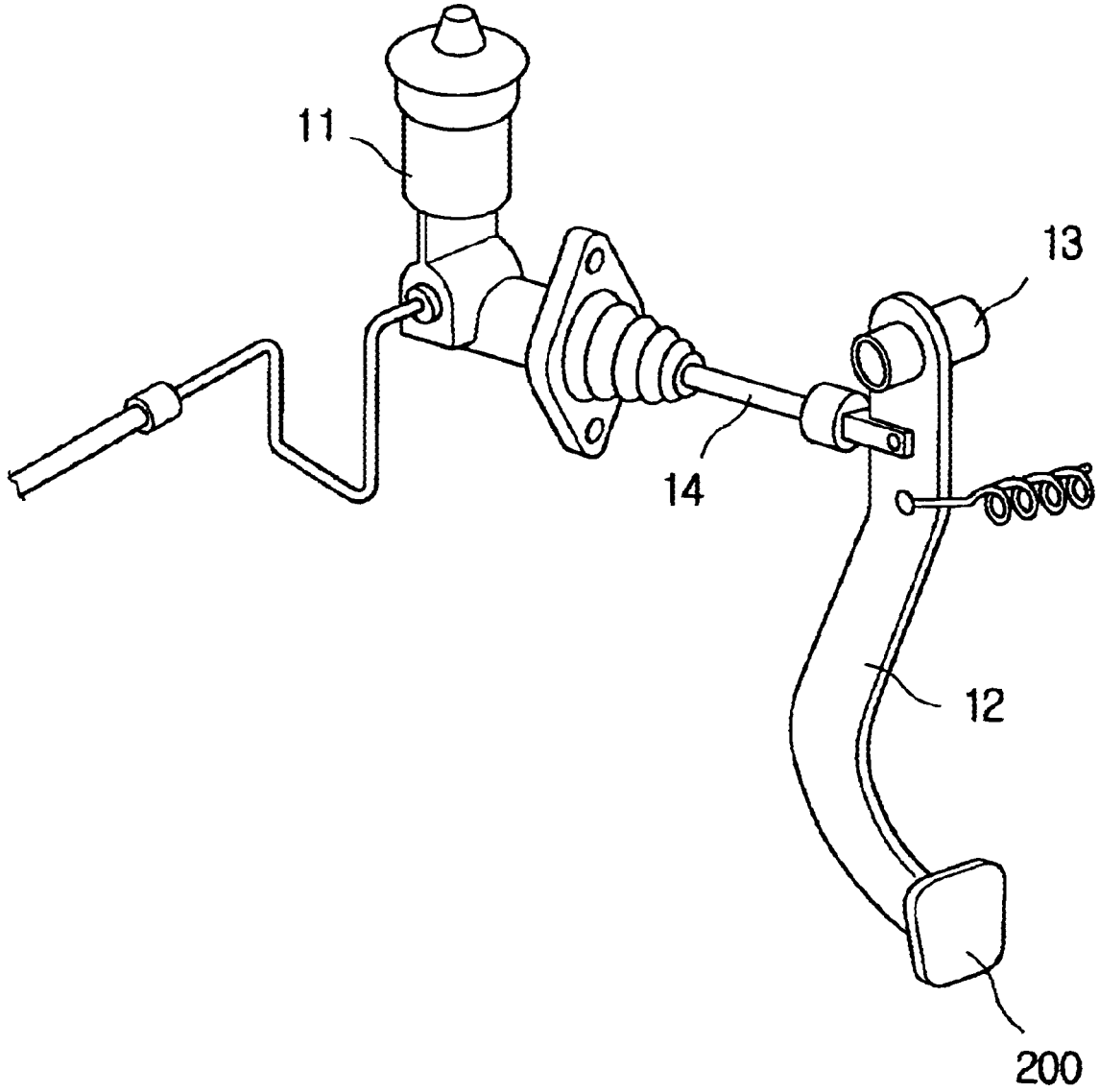
FIG. 1 illustrates a typical brake system for an automobile.
Figure 2A:
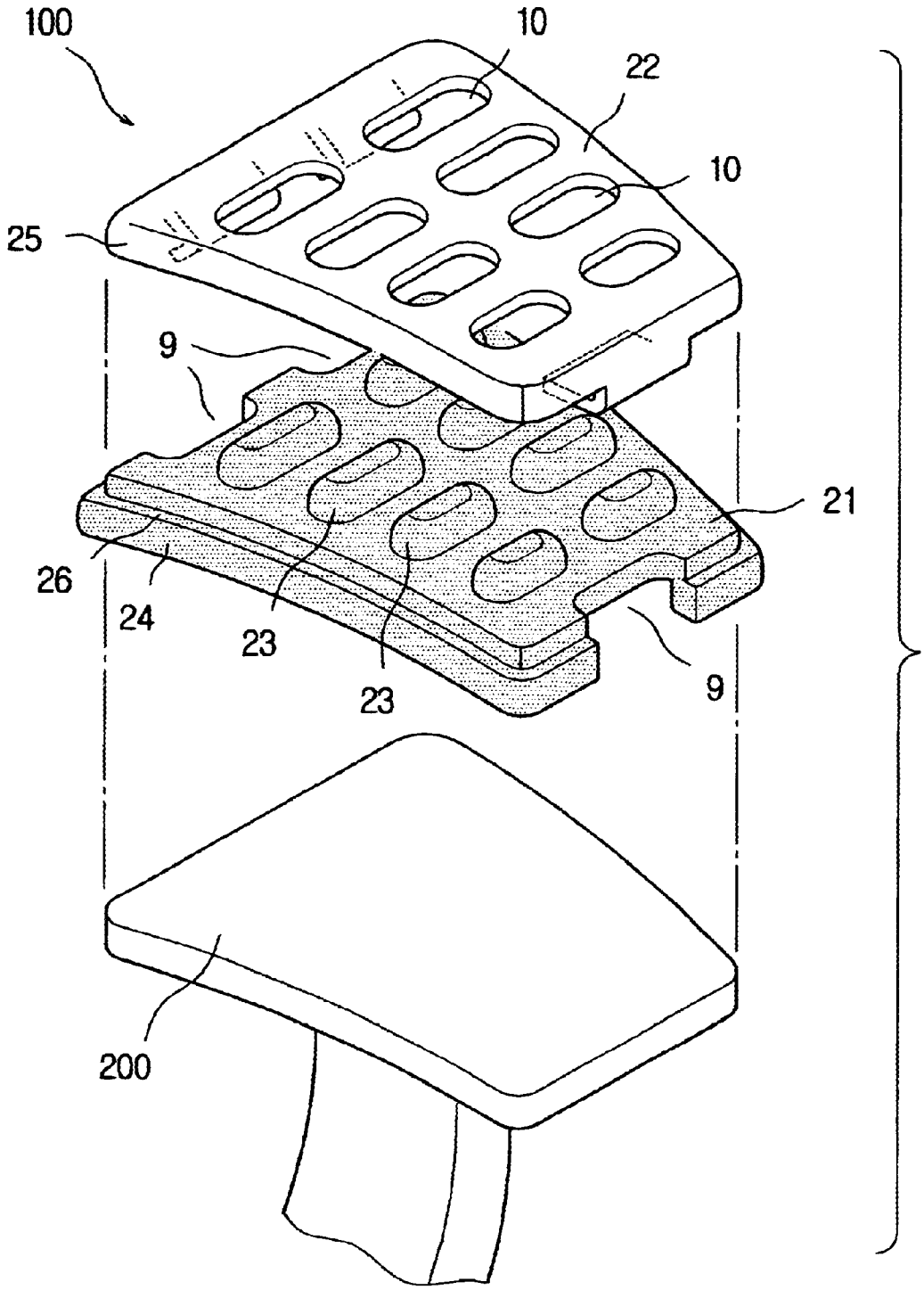
FIG. 2*a* is an exploded view illustrating an attachable pedal cover with a rubber pad and a holding cap according to the present invention.
Figure 2B:
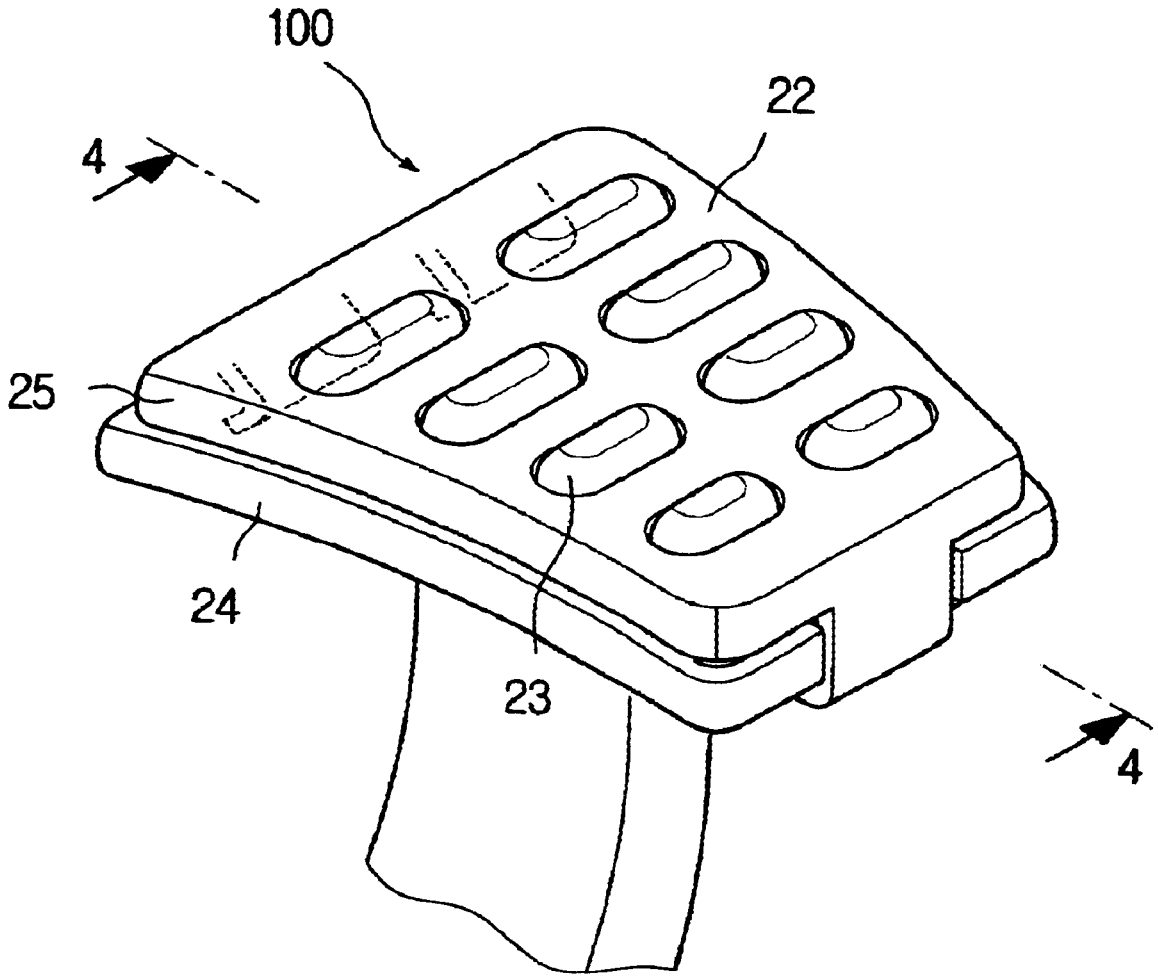
FIG. 2*b* is an assembly of attachable pedal cover with a rubber pad and a holding cap according to the present invention.

As shown in FIG. 2, an attachable pedal cover 100 according to the present invention is comprised of a rubber pad 21 with an anti-slip means and a holding cap 22 made of stainless or colored aluminum to cover the outer surface of the rubber pad 21. The attachable pedal cover 100 has the same shape and surface curvature for overlapping on the flat pedal 200.

The rubber pad 21 is comprised of a plurality of anti-slip protrusions 23 formed on its top surface, an outer wall 24 with the same thickness as the automobile flat pedal 200 and integrally formed with the rubber pad 21, a stepped portion 26 fitted with a bent portion 25 of holding cap 22 and three cutouts 9 located at the top and bottom edges for setting a coupling clip 7 and a locking projection 8 of the holding cap 22.

The holding cap 22 is comprised of a plurality of slot-holes 10 for inserting the plurality of anti-slip protrusions 23, the bent portion 25 fitted to the stepped portion 26 of rubber pad 21, and the V shaped coupling clip 7 and the locking projection 8 integrally formed with the holding cap 22 and at the top and bottom edges. The coupling clip 7 is latched to the top edge of the flat pedal 200 and the locking projection 8 is latched to the other edge of the flat pedal 200.

When the holding cap 22 is installed over the rubber pad 21, the plurality of anti-slip protrusions 23 formed on the surface of rubber pad 21 are matched through the series of slot-holes 10 of the holding cap 22. The coupling clip 7 and the locking projection 8 disposed on the top and bottom edges of holding cap 22 are inserted through the cutouts 9 of rubber pad 21, and the bent portion 25 of holding cap 22 is fitted to the stepped portion 26.

Therefore, the attachable pedal cover 100 is simply mounted on the flat pedal 200 by snapping.

When the attachable pedal cover 100 is installed on the flat pedal 200, the rubber pad 21 is overlapped to contact with the top surface of flat pedal 200. The holding cap 22 is then covered over the rubber pad 21. Then, the rubber pad 21 and the holding cap 22 are installed as a set. It will be appreciated that the mounting process is thereby made more convenient.

Figure 3A:
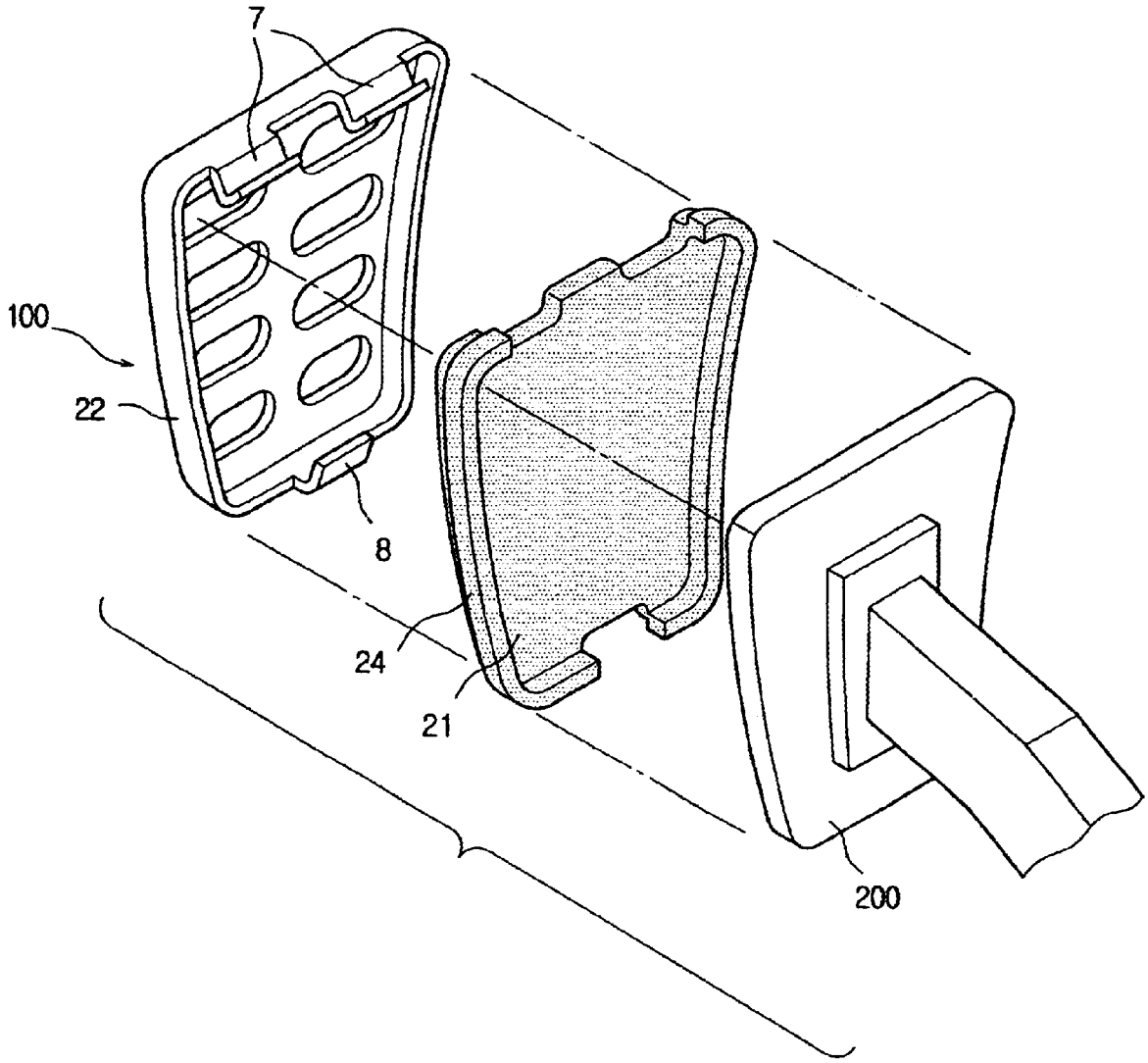
FIG. 3*a* is a back view of an exploded attachable pedal covet with a rubber pad and a holding cap according to the present invention.
Figure 3B:
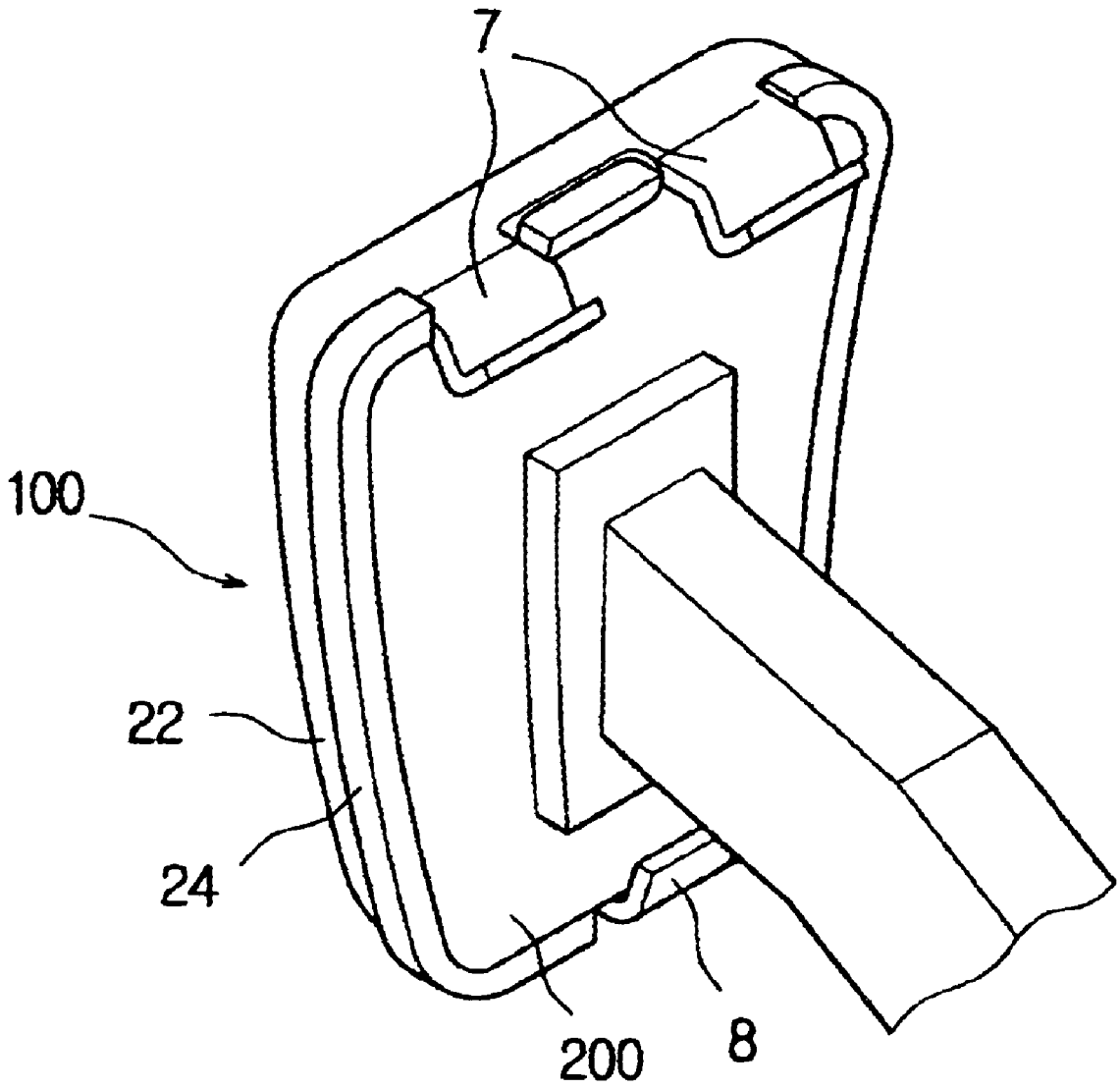
FIG. 3*b* is a back view of the assembled attachable pedal cover with a rubber pad and a holding cap according to the present invention.
Figure 4:
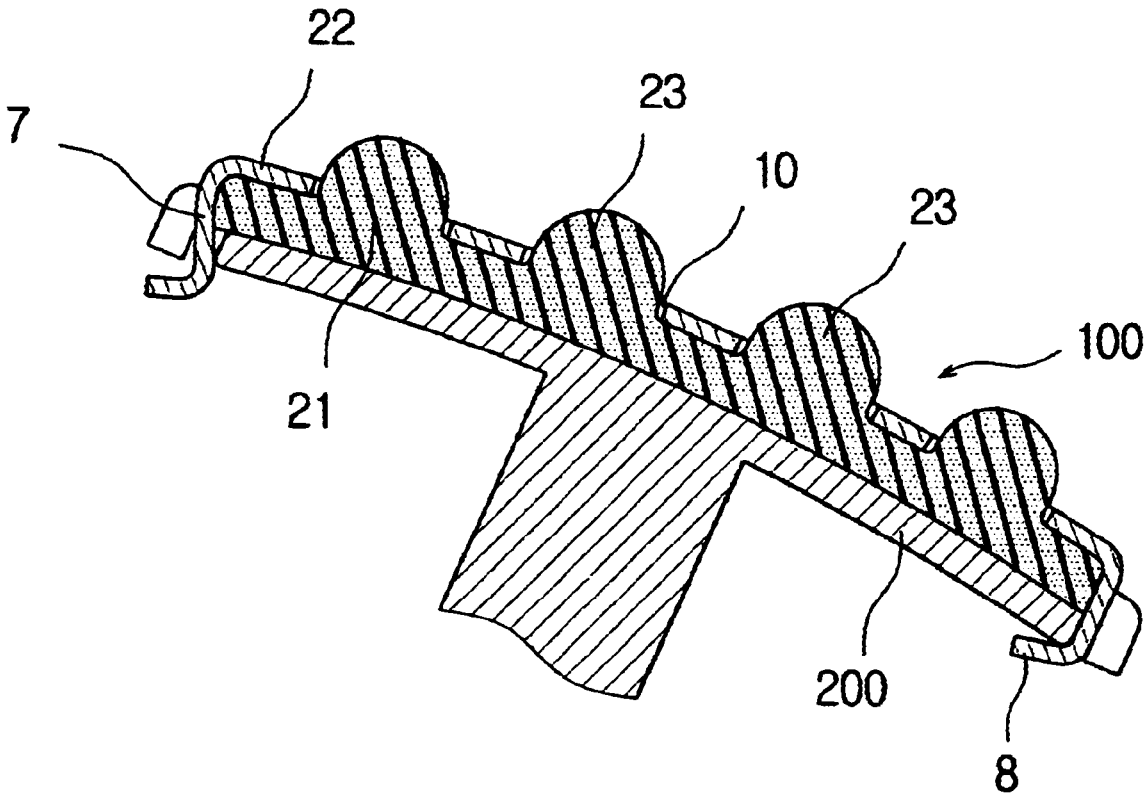
FIG. 4 is a cross-section view of A—A from the assembly of attachable pedal cover on an automobile pedal according to the present invention.
Figure 5:
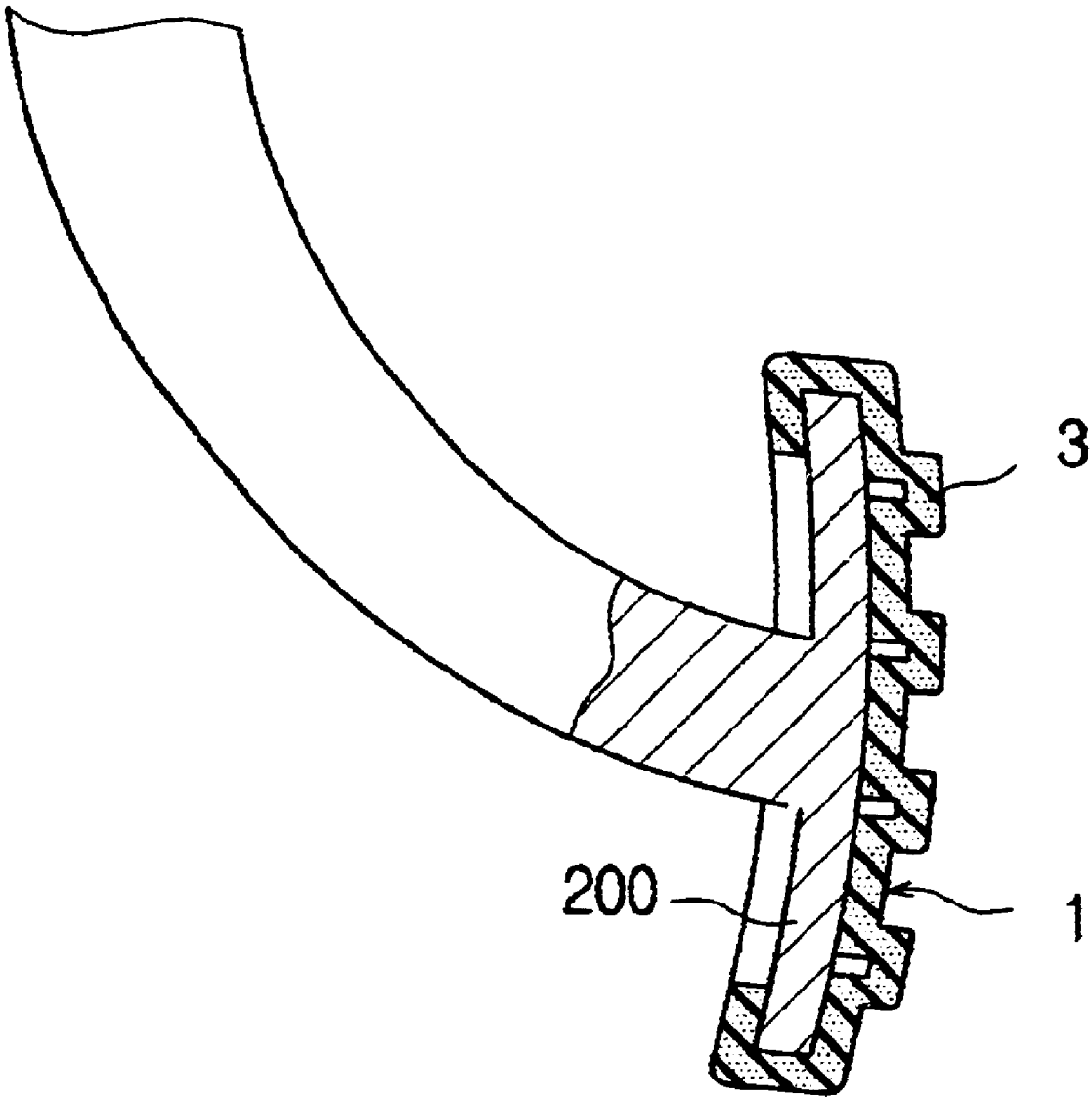
Fig.5 (Prior Art)
FIG. 5 is a sectional view of a conventional pedal cover mounted on the flat pedal.

In more detail, the rubber pad 21 is overlapped to closely contact with the built-in flat pedal 200. The locking projection 8 disposed at the bottom edge of the holding cap 22 as shown in FIG. 3 is inserted through the cutout 9 disposed at the bottom edge of the rubber pad 21 for tightly fitted into the flat pedal 200. Then the V-shape coupling clip 7 disposed at the top end of the holding cap 22 is inserted through the cutouts 9 disposed at the top edge of the rubber pad 21. The V-shape coupling clip 7 forcibly pushes against the top edge of the flat pedal 200 to snap in the holding cap 22. At this time, the coupling clip 7 is slightly bent upward to latch the top edge of the pedal 200. As soon as the coupling clip 7 latches the top edge of flat pedal 200, the coupling clip 7 returns to its original shape by restoring tension for firmly engaging the back surface of top edge of the flat pedal 200. Thereby, the attachable pedal cover 100 is installed to the flat pedal 200.

Specifically, the outer wall 24 having the same thickness of the flat pedal 200, is designed for fitting into the conventional flat pedal 200. The bottom portion and the inner periphery of the rubber pad 21 are designed to match the outer periphery of the flat pedal 200. When the attachable pedal cover 100 including the rubber pad 21 and the holding cap 22 is mounted on the flat pedal 200, the periphery of the flat pedal 200 is surrounded by the outer wall 24 of the rubber pad 21 in such a manner that the rubber pad 21 and the flat pedal 200 become a solid body. Therefore, even if an extraordinary force such as a strong impact by the operator is applied during the operation of the vehicle, the attachable pedal cover 100 will not slip from or separate from the flat pedal 200.

The plurality of anti-slip protrusions 23 of the rubber pad 21 are inserted out through the plurality of slot-holes 10 of the holding cap 22 in order to contact with the operator's foot for the prevention of slipping during the manipulation of the pedal. Thereby, the pedal cover 100 can carry out its inherent function. In addition, the holding cap 22 of the attachable pedal cover 100, being made of stainless or colored aluminum has decorative embossing and excellent glazing and roughness designed for decorating the car's interior.

On the other hand, even though the operator repeatedly presses the attachable pedal cover 100 of the present invention, the plurality of anti-slip protrusions 23 and the holding cap 22 will not easily wear out. The rubber pad 21 protruding out through the slot-holes of the holding cap 22 may be worn off after the elapse of certain time and through usage. In this case, the rubber pad 21 can be easily replaced with a new one. When the attachable pedal cover 100 is removed from the flat pedal 200, the V-shaped coupling clip 7 of the top edge of holding cap 22 is forcibly lifted upward and the attachable pedal cover 100 pulls forward to separate from the flat pedal 200. At the same time, the attachable pedal cover 100 snaps out in such a manner that the locking projection 8 of the bottom edge of holding cap 22 is separated from the flat pedal 200. Therefore, the old anti-slip protrusions could be slightly pushed out from the plurality of slot-holes 10 of holding cap 22 to remove the old rubber pad. Then, a new rubber pad can replace the old pad. In the same manner as mentioned above, a new attachable pedal cover 100 is mounted on the flat pedal 200. As described above, the attachable pedal cover 100 of the present invention is replaceable in simple and convenient ways.

As described above, an attachable pedal cover according to the present invention is comprised of a rubber pad for preventing the slipping of an operator's foot during pedal operation and a holding cap made of a stainless or colored aluminum, which provides excellent decorative effect. The holding cap is comprised of a coupling clip and a locking projection for mounting or removing the attachable pedal cover. The installation of the attachable pedal cover can be implemented in an effective way even within a relatively narrow place. The holding cap has a decorative feature, which enhances the appearance of a car's interior.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An attachable pedal cover for snapping into an automobile pedal comprises:

a rubber pad (21) with a plurality of anti-slip means (23) on the surface that has the same shape for overlapping said automobile pedal (200), a holding cap (22) having a plurality of slot-holes (10) for inserting said plurality of anti-slip means (23), a latching means forming a locking projection (8) and a pair of coupling clips (7) for retaining said rubber pad (21) by snapping into said automobile pedal (200), and a bent portion (25) integrally formed around edges of said holding cap (22) for fitting said rubber pad (21).

2. The attachable pedal cover according to claim 1, wherein said rubber pad (21) further comprises a stepped portion (26) integrally formed around edges for fitting into said bent portion (25) of holding cap (22).

3. The attachable pedal cover according to claim 2, wherein said lubber pad (21) further comprises an outer wall (24) integrally formed around bottom edges of said stepped portion (26), said outer wall (24) has same thickness of said automobile pedal (200).

4. The attachable pedal cover according to claim 1, wherein said rubber pad (21) further comprises a pair of cutouts (9) at top edge and a cutout (9) at bottom edge.

5. The attachable pedal cover according to claims 1, wherein said locking projection (8) integrally formed at bottom edge of said holding cap (22), and said a pair of coupling clips (7) integrally formed at top edge of said holding cap (22).

6. The attachable pedal cover according to claim 1, wherein said holding cap (22) is made of stainless steel.

7. The attachable pedal cover according to claim 1, wherein said holding cap (22) is made of colored aluminum.

* * * * *